US011466634B1

(12) United States Patent
Wooldridge et al.

(10) Patent No.: US 11,466,634 B1
(45) Date of Patent: Oct. 11, 2022

(54) METHODS AND SYSTEM FOR STARTING AN ENGINE

(71) Applicant: Ford Global Technologies, LLC, Dearborn, MI (US)

(72) Inventors: Steven Wooldridge, Manchester, MI (US); Xiaogang Zhang, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/649,025

(22) Filed: Jan. 26, 2022

(51) Int. Cl.

| | |
|---|---|
| ***F02D 41/06*** | (2006.01) |
| ***F02B 75/02*** | (2006.01) |
| ***F01N 3/20*** | (2006.01) |
| ***F02N 11/08*** | (2006.01) |
| ***F02P 5/15*** | (2006.01) |
| ***F02D 41/38*** | (2006.01) |

(52) U.S. Cl.
CPC ..... *F02D 41/064* (2013.01); *F01N 3/2013* (2013.01); *F02B 75/02* (2013.01); *F02D 41/38* (2013.01); *F02N 11/0803* (2013.01); *F02P 5/15* (2013.01); *F02B 2075/025* (2013.01); *F02B 2075/027* (2013.01); *F02D 2041/389* (2013.01); *F02N 2200/026* (2013.01)

(58) Field of Classification Search
CPC .. F02D 41/064; F02D 41/38; F02D 2041/389; F01N 3/2013; F02B 75/02; F02B 2075/025; F02B 2075/027; F02N 11/0803; F02N 2200/026; F02P 5/15
USPC ..... 701/112, 113; 123/179.5, 491, 685, 676, 123/406.55
See application file for complete search history.

(56) References Cited

U.S. PATENT DOCUMENTS

| | | | | |
|---|---|---|---|---|
| 7,082,899 | B2 | 8/2006 | Hanson et al. | |
| 7,234,440 | B2 | 6/2007 | Hilditch | |
| 8,096,108 | B2 | 1/2012 | Najt et al. | |
| 9,382,857 | B2 | 7/2016 | Glugla et al. | |
| 9,726,094 | B2 | 8/2017 | Younkins et al. | |
| 9,957,867 | B2 | 5/2018 | Zhang | |
| 10,184,407 | B2 | 1/2019 | Zhang | |
| 2010/0300383 | A1* | 12/2010 | Pursifull | F02B 69/06 123/21 |
| 2017/0254283 | A1 | 9/2017 | Glugla | |

* cited by examiner

*Primary Examiner* — Hai H Huynh
(74) *Attorney, Agent, or Firm* — Vincent Mastrogiacomo; McCoy Russell LLP

(57) ABSTRACT

Systems and methods for operating an internal combustion engine that is included in a hybrid vehicle are described. In one example, the internal combustion engine is operated in a two stroke mode during cold starting to increase mass flow to an electrically heated catalyst so that engine emissions may be reduced.

20 Claims, 4 Drawing Sheets

METHODS AND SYSTEM FOR STARTING AN ENGINE

FIELD

The present description relates to methods and a system for operating an internal combustion engine of a hybrid vehicle.

BACKGROUND AND SUMMARY

A hybrid vehicle may include an internal combustion engine that provides mechanical power to propel the hybrid vehicle. In addition, the internal combustion engine may provide mechanical power that is converted to electric power. The electric power may be consumed via an electric machine to propel the vehicle. The internal combustion engine may be shut off while an electric energy storage device has a sufficient level or stored charge. Additionally, there may be a delay in starting the internal combustion engine when the hybrid vehicle is activated so that the hybrid vehicle emissions and fuel consumption may be reduced. Nevertheless, the engine may be started from time to time to increase powertrain torque output or to charge the hybrid vehicle's electric energy storage device. During times when the engine has cooled and is then restarted, engine emissions may be increased due to low catalyst efficiency and higher engine feed gas emissions. Therefore, it may be desirable to provide a way of reducing engine emissions of a hybrid vehicle when an engine of a hybrid vehicle is cold started.

The inventors herein have recognized the above-mentioned issues and have developed a method for operating an engine via a controller, comprising: prior to a catalyst temperature reaching a light off temperature after an engine cold start, operating all cylinders of the engine in a two stroke mode, combusting fuel in a first group of cylinders of the engine, and not combusting fuel in a second group of cylinders of the engine.

By operating the engine in a two stroke mode with some cylinders combusting air and fuel while others pump air and fuel to a catalyst, it may be possible to provide the technical result of reducing tailpipe emissions. In particular, for a given engine speed, a mass flow rate through the engine may be increased by operating the engine in a two stroke mode as compared to operating the engine in a four stroke mode so that a catalyst may reach a catalyst light off temperature (e.g., a temperature at which the catalyst efficiency for converting exhaust gases (e.g., HC, CO, NOx) may exceed a threshold efficiency (e.g., 50%)) sooner, thereby reducing tailpipe emissions. In addition, by not combusting fuel in a group of cylinders while supplying fuel to the group of cylinders, less energy of the fuel injected to the group of cylinder may be lost to engine heating so that a temperature of a catalyst may be increased sooner.

The present description may provide several advantages. In particular, the approach may improve reduce tailpipe emissions of a vehicle. Further, the approach may increase a mass flow rate of exhaust gases and fuel vapor to a catalyst during catalyst heating to reduce catalyst heating time. In addition, the approach may supply even greater amounts of energy to heat the catalyst by operating the engine without producing torque from combustion to rotate the engine.

The above advantages and other advantages, and features of the present description will be readily apparent from the following Detailed Description when taken alone or in connection with the accompanying drawings.

The summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 3:
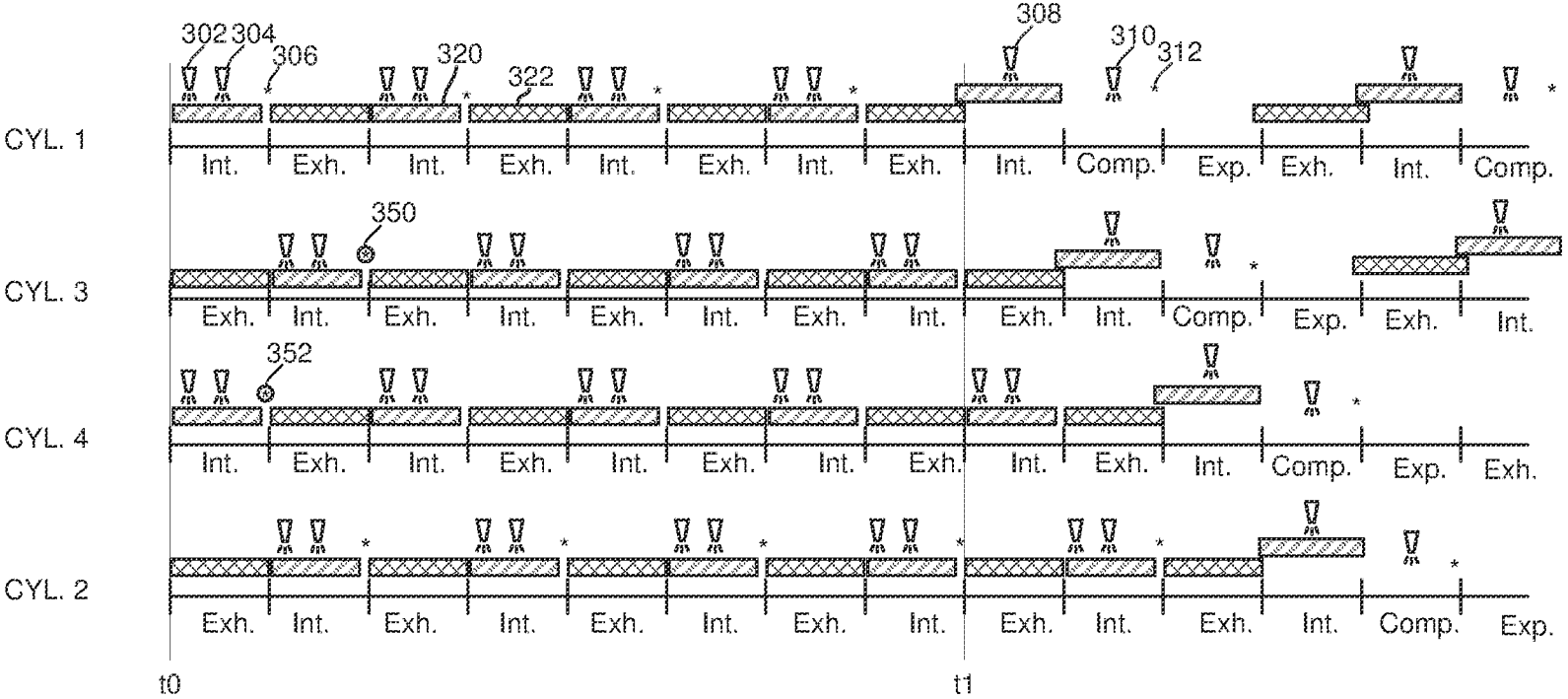
FIG. 3 shows a plot of an example cold starting engine sequence according to the method of FIG. 4.
Figure 4:
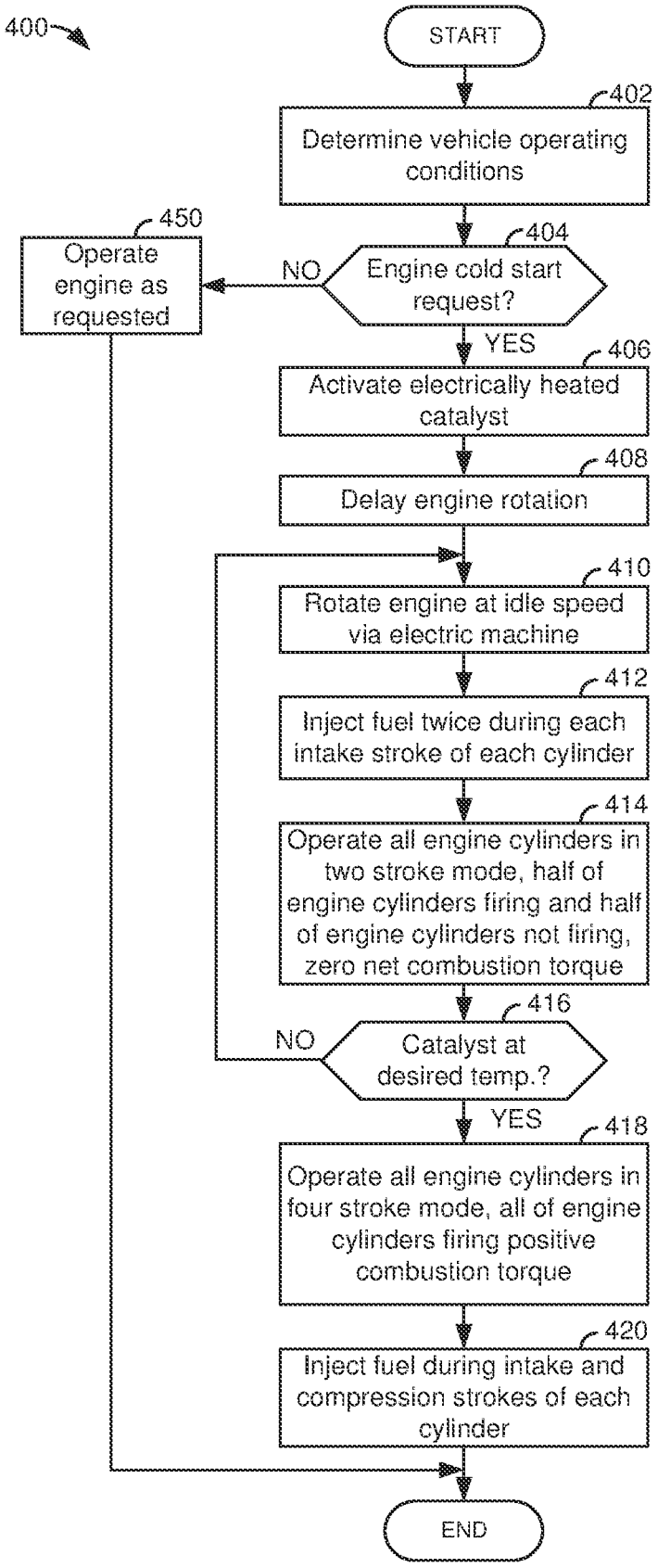
FIG. 4 shows a flowchart of a method for cold starting an engine.

The present description is related to operating a hybrid vehicle. The hybrid vehicle may include an engine of the type shown in FIG. 1. The engine may be included in a driveline of the type shown in FIG. 2 or in other series/parallel hybrid drivelines. The engine may be operated according to the sequence shown in FIG. 3. A flowchart of a method for operating a vehicle that includes an engine and a power split transmission is shown in FIG. 4.

Figure 1:
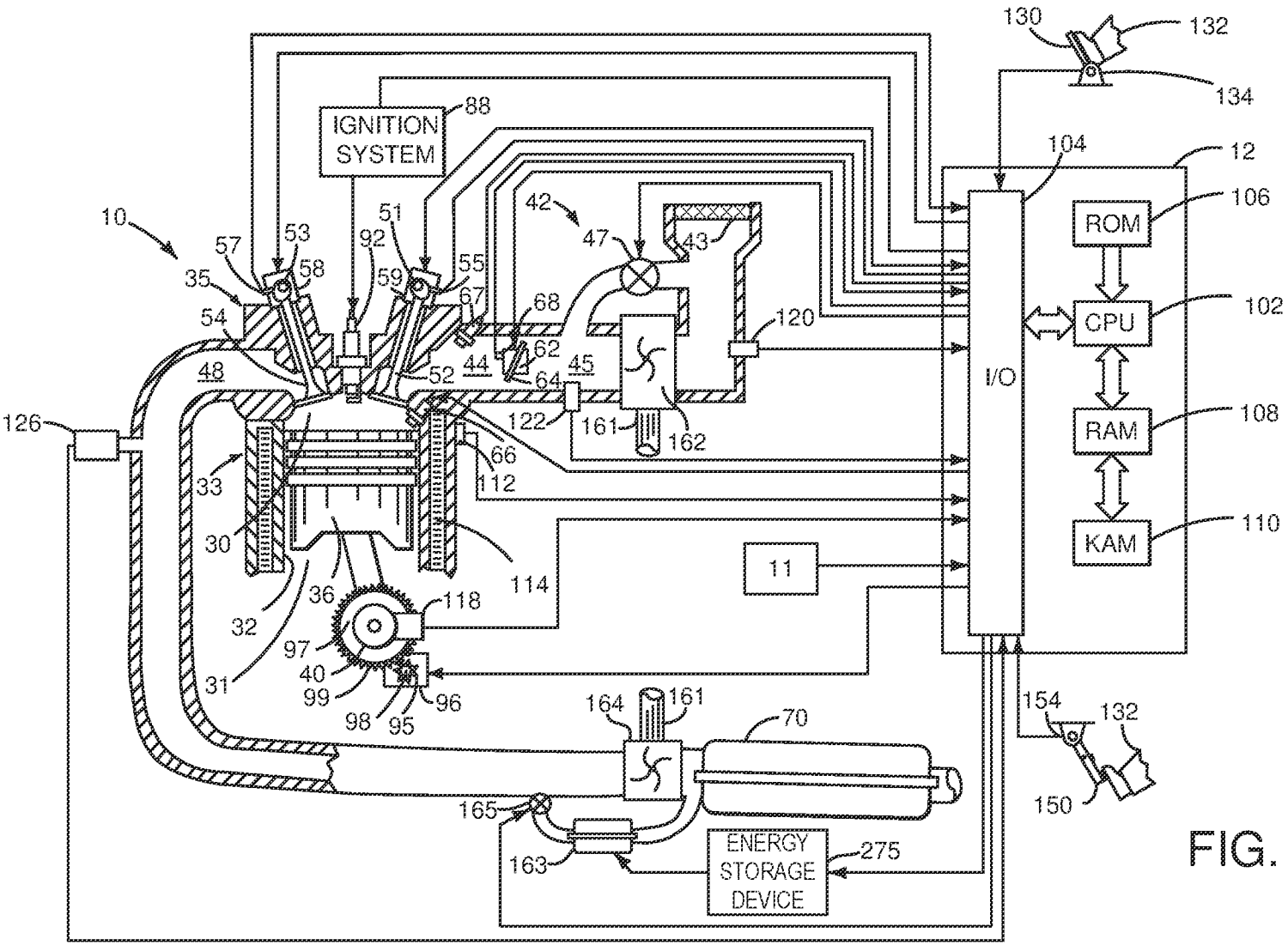
FIG. 1 illustrates a schematic diagram of an engine.

Referring to FIG. 1, internal combustion engine 10 (also referred to as "engine"), comprising a plurality of cylinders, one cylinder of which is shown in FIG. 1, is controlled by controller 12 (e.g., an electronic engine controller). The controller 12 receives signals from the various sensors shown in FIGS. 1 and 2. The controller 12 also employs the actuators shown in FIGS. 1 and 2 to adjust engine and driveline operation based on the received signals and instructions stored in memory of controller 12.

Engine 10 is comprised of cylinder head 35 and block 33, which includes combustion chamber 30 and cylinder walls 32 in cylinder 31. Piston 36 is positioned therein and reciprocates via a connection to crankshaft 40. Flywheel 97 and ring gear 99 are coupled to crankshaft 40. Optional starter 96 (e.g., low voltage (operated with less than 30 volts) electric machine) includes pinion shaft 98 and pinion gear 95. Pinion shaft 98 may selectively advance pinion gear 95 to engage ring gear 99. Starter 96 may be directly mounted to the front of the engine or the rear of the engine. In some examples, starter 96 may selectively supply power to crankshaft 40 via a belt or chain. In one example, starter 96 is in a base state when not engaged to the engine crankshaft. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57. Intake valve 52 may be selectively activated and deactivated by valve activation device 59. Exhaust valve 54 may be selectively activated and deactivated by valve activation device 58. Valve activation devices 58 and 59 may be electromechanical devices. In some embodiments, activation device 59 and activation device 58 may be cam profile switching devices such that intake valve 52 and exhaust valve 54 may follow different cam profiles during different engine operating conditions. In one example, valve activation devices 58 and 59 may switch between cam profiles for two stroke engine operation and four stroke engine operation as shown in FIG. 3.

Direct fuel injector 66 is shown positioned to inject fuel directly into combustion chamber 30, which is known to those skilled in the art as direct injection. Port fuel injector 67 is shown positioned to inject fuel into the intake port of combustion chamber 30, which is known to those skilled in the art as port injection. Direct fuel injector 66 and port fuel injector 67 deliver liquid fuel in proportion to pulse widths provided by controller 12. Fuel is delivered to fuel direct fuel injector 66 and port fuel injector 67 by a fuel system (not shown) including a fuel tank, fuel pump, and fuel rail (not shown).

In addition, intake manifold 44 is shown communicating with turbocharger compressor 162 and engine air intake 42. In other examples, turbocharger compressor 162 may be a supercharger compressor. Shaft 161 mechanically couples turbocharger turbine 164 to turbocharger compressor 162. Optional electronic throttle 62 (also referred to as "throttle") adjusts a position of throttle plate 64 to control air flow from turbocharger compressor 162 to intake manifold 44. Pressure in boost chamber 45 may be referred to a throttle inlet pressure since the inlet of throttle 62 is within boost chamber 45. The throttle outlet is in intake manifold 44. In some examples, throttle 62 and throttle plate 64 may be positioned between intake valve 52 and intake manifold 44 such that throttle 62 is a port throttle. Compressor recirculation valve 47 may be selectively adjusted to a plurality of positions between fully open and fully closed. Air filter 43 cleans air entering engine air intake 42.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalyst 70. Alternatively, a two-state exhaust gas oxygen sensor may be substituted for UEGO sensor 126.

Exhaust gases may be processed via catalyst 70 and/or via electrically heated catalyst 163. Electrically heated catalyst 163 may receive electric power from electric energy storage device 175 (e.g., a high voltage battery) to increase a temperature of electrically heated catalyst 163. Electrically heated catalyst may include a heater, substrate, and washcoat (not shown). Exhaust gases may enter electrically heated catalyst 163 when turbocharger bypass valve 165 is open. Catalyst 70 can include multiple bricks and a three-way catalyst coating, in one example. In another example, multiple emission control devices, each with multiple bricks, can be used.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to a driver demand pedal 130 (e.g., a human/machine interface) for sensing force applied by human vehicle driver 132; a position sensor 154 coupled to brake pedal 150 (e.g., a human/machine interface) for sensing force applied by human vehicle driver 132, a measurement of engine manifold pressure (MAP) from pressure sensor 122 coupled to intake manifold 44; an engine position sensor from an engine position sensor 118 sensing crankshaft 40 position; a measurement of air mass entering the engine from sensor 120; and a measurement of throttle position from sensor 68. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

Controller 12 may also receive input from human/machine interface 11. A request to start the engine or vehicle may be generated via a human and input to the human/machine interface 11. The human/machine interface 11 may be a touch screen display, pushbutton, key switch or other known device.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC).

During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion.

During the expansion stroke, the expanding gases push piston 36 back to BDC. Crankshaft 40 converts piston movement into a rotational power of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Figure 2:
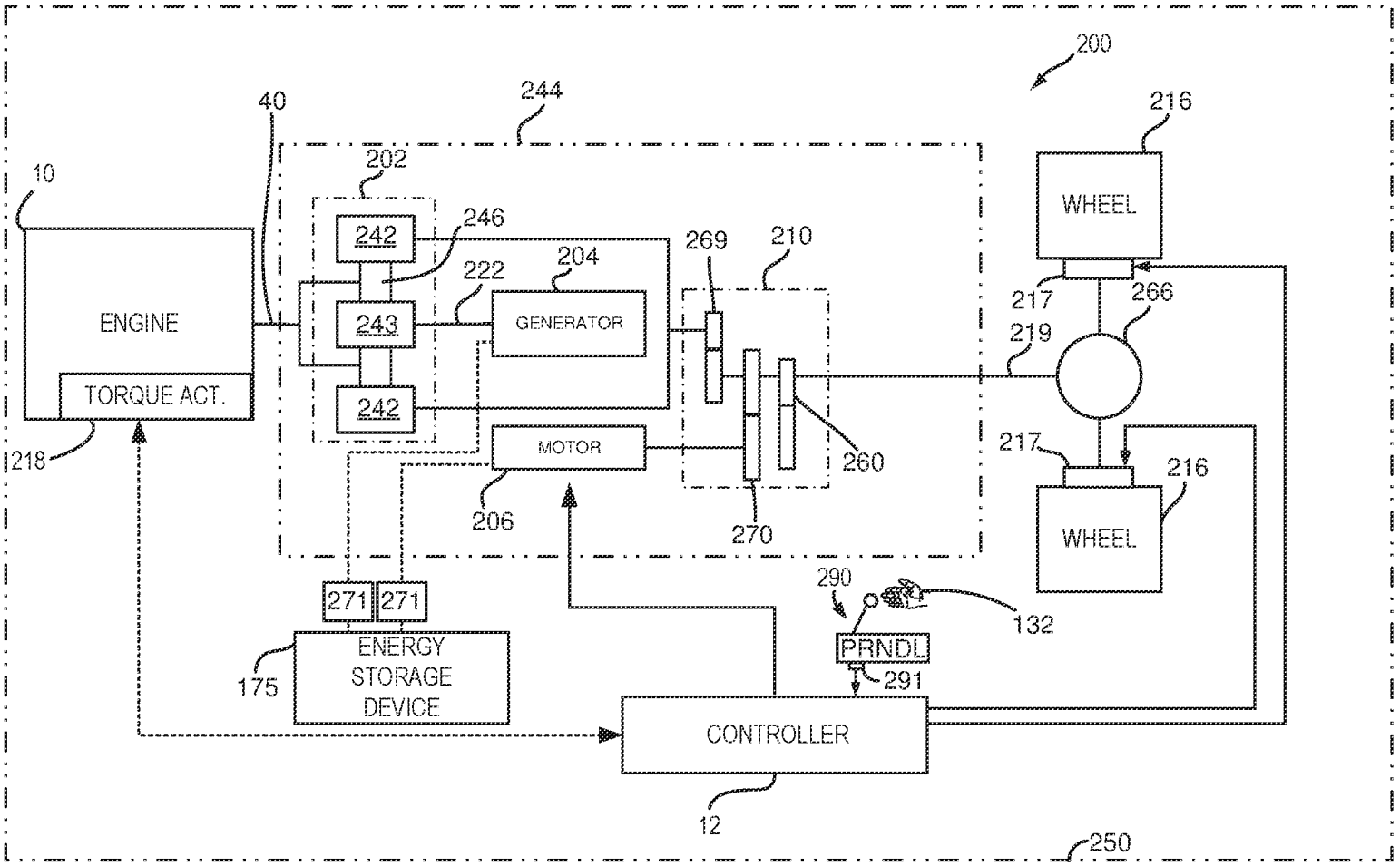
FIG. 2 illustrates a schematic diagram of a hybrid vehicle driveline.

Referring now to FIG. 2, an example of a driveline 200 is shown. Driveline 200 includes engine 10 and torque actuator 218. Torque actuator 218 may be a throttle, fuel injector, camshaft actuator, ignition system, or other actuator that may adjust engine torque. Engine 10 delivers power to transmission 244 via crankshaft 40. In the depicted example, transmission 244 is a power-split transmission (or transaxle) that includes a planetary gear set 202 that includes one or more rotating gear elements. Transmission 244 further includes an electric generator 204 and an electric motor 206. The electric generator 204 and the electric motor 206 may also be referred to as electric machines as each may operate as either a motor or a generator. Torque may be output from transmission 244 to propel vehicle 250 using traction wheels 216 via a power transfer gearing 210, a torque output shaft 219, and a differential-and-axle assembly 266. A braking torque may be provided via friction or foundation brakes 217.

Electric generator 204 and electric motor 206 are electrically coupled to electric energy storage device 175 such that each of electric generator 204 and electric motor 206 may be operated using electric energy from an electric energy storage device 175 (e.g., a high voltage battery). In some examples, an energy conversion device, such as an inverter 271, may be coupled between the battery and the motor to convert the DC output of the battery into an AC output for use by electric motor 206. Due to the mechanical properties of the planetary gear set 202, electric generator 204 may be driven by a power output element (on an output side) of the planetary gear set 202 via mechanical connection 222.

Electric motor 206 may be operated in a regenerative mode, that is, as a generator, to absorb kinetic energy from the vehicle and/or the engine and convert the absorbed kinetic energy to an energy form suitable for storage in electric energy storage device 175. In addition, electric motor 206 may be operated as a motor or generator, as required, to augment or absorb torque provided by the engine, such as during a transition of engine 10 between different combustion modes.

Planetary gear set 202 comprises a ring gear 242, a sun gear 243, and a planetary gear carrier 246. The ring gear and sun gear may be coupled to each other via the planetary gear carrier 246. Crankshaft 40 of engine 10 is mechanically coupled to planetary gear carrier 246 and sun gear 243 is mechanically coupled to electric generator 204. Ring gear 242 is mechanically coupled to power transfer gearing 210 including one or more meshing gear elements 260. Electric motor 206 drives gear element 270 and electric generator 204 is coupled to sun gear 243. In this way, the planetary gear carrier 246 (and consequently the engine and generator) may be coupled to the vehicle's wheels and the electric motor 206 via one or more gear elements.

Hybrid propulsion system or driveline 200 may be operated in various modes including a full hybrid mode, wherein the vehicle is driven by only engine 10 and electric generator 204 cooperatively, or only the electric motor 206, or a combination of the same. Alternatively, assist or mild hybrid examples may also be employed, wherein the engine 10 is the primary source of power and the electric motor 206 selectively adds torque during specific conditions, such as during an accelerator tip-in event (e.g., application of the accelerator pedal).

The vehicle may be driven in a first engine-on mode, which may be referred to as an "engine" mode, wherein engine 10 is operated in conjunction with the electric generator 204 (which provides reaction torque to the planetary gear-set and allows a net planetary output torque for propulsion of the vehicle) and used as the primary source of power and torque for powering traction wheels 216. In this mode, electric generator 204 may generate electric power, and the electric power generated may be applied by the electric motor 206 to propel the vehicle as well. This may result in no net power being delivered to the electric energy storage device 175 or the high voltage accessories from the engine power. If the electric motor 206 did not use the generator power, that generator power would have to be used by the high voltage accessories or to charge the high voltage battery. All power generated by the engine is consumed in a power split system. During the "engine" mode, fuel may be supplied to engine 10 from a fuel tank via direct fuel injector 66 so that the engine can spin fueled to provide the torque for propelling the vehicle. Specifically, engine power is delivered to the ring gear 242 of the planetary gear set 202, thereby delivering power to traction wheels 216. Optionally, the engine may be operated to output more torque than is needed for propulsion, in which case the additional power may be absorbed by electric generator 204 (in a generating mode) to charge electric energy storage device 175 or supply electrical power for other vehicle electrical loads.

In another example, the hybrid propulsion system may be driven in a second engine-on mode, which may be referred to as an "assist" mode. During assist mode, engine 10 is operated and used as the primary source of torque for powering traction wheels 216 and electric motor 206 is used as an additional torque source to act in cooperation with, and supplement the torque provided by engine 10. During the "assist" mode, as in the engine-only mode, fuel is supplied to engine 10 so as to spin the engine fueled and provide torque to the vehicle wheels.

In still another example, the hybrid propulsion system or driveline 200 may be driven in an engine-off mode, which may be referred to as an electric-only mode, wherein battery powered electric motor 206 is operated and used as the only source of power for driving traction wheels 216. As such, during the engine-off mode, no fuel may be injected to engine 10 irrespective of whether the engine is spinning or not. The "engine-off" mode may be employed, for example, during braking, during low driver demands, and while the vehicle is stopped at traffic signals, etc. Specifically, motor power is delivered to gear element 270, which in turn drives the meshing gear elements 260, thereby driving traction wheels 216. The electric generator 204 spins so that all of the rotation of ring gear 242 is balanced and planetary gear carrier 246 has a net zero speed, thereby allowing the engine to not spin.

During the engine-off mode, based on vehicle speed and driver demand torque, the vehicle may be operated in a first electric-only mode, wherein the vehicle is propelled by the electric energy storage device 175 via the electric motor 206 with the engine not spinning and not fueled, or in a second electric-only mode wherein the vehicle is propelled by the electric energy storage device 175 via electric motor 206 with the engine spinning unfueled. During the second electric-only mode, the electric generator 204 applies torque to planetary gear set 202 through sun gear 243. The planetary gear carrier 246 provides reaction torque to this generator torque, and consequently directs torque to the engine 10 to spin the engine 10, during engine starting for example. In this example, the reaction torque provided by planetary gear carrier 246 is supplied to electric motor 206 (or alternatively vehicle momentum when vehicle speed is decreasing), and consequently reduces torque from the motor to the wheels.

Shifter 290 may receive input from human vehicle driver 132 to select an operating mode for transmission 244. Shifter 290 may be placed into one of a plurality of positions or states as indicated by PRNDL. A driver may request that transmission 244 be in park when shifter 290 is moved to the "P" position. The driver may request that the transmission 244 be in reverse when shifter 290 is in the "R" position. The driver may request that the transmission 244 be in neutral when shifter 290 is in the "N" position. The driver may request that the transmission 244 be in drive when shifter 290 is in the "D" position. The driver may request that the transmission 244 be in low when shifter 290 is in the "L" position. Note that a low selection in the power split system is not a gear selection. Rather, it may simulates engine braking when the drive demand pedal is fully released by generating more regenerative braking torque and/or spinning the engine unfueled to generate a torque on the wheels to reduce vehicle speed. The position of shifter 290 may be determined via shifter position sensor 291.

Thus, the system of FIGS. 1 and 2 provides for a system, comprising: an internal combustion engine; an electric machine coupled to the internal combustion engine; and a controller including executable instructions stored in non-transitory memory that cause the controller to operate a first group of cylinders in a two stroke mode while combusting fuel in the first group of cylinders, operate a second group of cylinders in the two stroke mode while not combusting fuel in the second group of cylinders, and inject fuel to the second group of cylinders while not combusting fuel in the second group of cylinders. In a first example, the system further comprises additional instructions that cause the controller to inject fuel twice during an intake stroke of a cylinder included in the second group of cylinders while operating the second group of cylinders in the two stroke mode. In a second example that may include the first example, the system further comprises additional instructions that cause the controller to supply spark to a cylinder during an intake stroke of the cylinder, the cylinder included in the first group of cylinders. In a third example that may include one or more of the first and second examples, the system includes where the spark is supplied while an intake valve of the cylinder is closed. In a fourth example that may include one or more of the first through third examples, the system further comprises an electric machine and additional instructions that cause the controller to rotate the engine at an idle speed via the electric machine. In a fifth example that may include one or more of the first through fourth examples, the system includes where the first group of cylinders and the second group of cylinders are operated in the two stroke mode prior to a catalyst temperature reaching a light off temperature after an engine cold start.

Referring now to FIG. 3, an engine operating sequence according to the method of FIG. 4 is shown. The operating sequence may be performed via the system of FIGS. 1 and 2 in cooperation with the method of FIG. 4. Vertical lines at times t0-t1 represent times of interest during the sequence. The plots in FIG. 3 are time aligned and occur at the same time. The sequence of FIG. 3 is for a four cylinder engine, but other engine configurations (e.g., six and eight cylinder engines) may be operated in a similar way.

The first plot from the top of FIG. 3 is a plot of the position of cylinder number one as the crankshaft of the engine that includes cylinder number one rotates. The cylinder position begins on the left side of the figure and it changes as the sequence moves toward the right side of the figure. Top dead center and bottom dead center piston positions for cylinder number one are indicated via vertical bars along the plot. Individual cylinder strokes are indicated along the horizontal axis. Cylinder strokes are abbreviated according to the following: "Int."—intake stroke, "Exh."—exhaust stroke, "Comp."—compression stroke, "Exp."—expansion stroke. Individual injections of fuel are indicated via nozzles as shown at 302 and 304. Thus, for cylinder number one, fuel is injected twice during an intake stroke as indicated at 302 and 304. Spark is delivered when an asterisk "*" is shown. Intake valve opening times are indicated by hatched bars such as 320. Exhaust valve opening times are indicated by cross-hatched bars such as 322. Intake and exhaust valves are closed when hatched and unhatched bars are not shown. Injection timing, spark timing, cylinder position, and valve timings for cylinders 2-4 follow the same designations as shown for cylinder number one.

The second plot from the top of FIG. 3 is a plot of the position of cylinder number three as the crankshaft of the engine that includes cylinder number three rotates. The cylinder position begins on the left side of the figure and it changes as the sequence moves toward the right side of the figure.

The third plot from the top of FIG. 3 is a plot of the position of cylinder number four as the crankshaft of the engine that includes cylinder number four rotates. The cylinder position begins on the left side of the figure and it changes as the sequence moves toward the right side of the figure.

The fourth plot from the top of FIG. 3 is a plot of the position of cylinder number two as the crankshaft of the engine that includes cylinder number two rotates. The cylinder position begins on the left side of the figure and it changes as the sequence moves toward the right side of the figure.

Thus, FIG. 3 shows plots of engine cylinder states in an order that corresponds to a firing order of the engine when the engine is operated as a conventional four stroke engine (e.g., 1-3-4-2). The sequence of FIG. 3 begins after an engine cold start has been requested and after the engine speed has reached a predetermined speed (e.g., an engine idle speed) via rotating the engine by an electric machine. Time t0 may represent the time that cylinder strokes begin where combustion is initiated in the engine since the engine was most recently stopped. Combustion in the cylinder strokes may begin after the engine reaches a predetermined speed (e.g., engine idle speed) after the engine cold start request. The engine operating mode (e.g., two stroke/four stroke) may be entered or commanded as the engine is rotated up to the predetermined speed.

At time t0, cylinder number one begins its intake stroke while cylinder number three enters its exhaust stroke. The position of the piston in cylinder number one is top dead center. The position of the piston in cylinder number three is bottom dead center. Cylinder number four begins its intake stroke while cylinder number two enters its exhaust stroke. The position of the piston in cylinder number four is top dead center. The position of the piston in cylinder number two is bottom dead center. Thus, the engine is operating in a two stroke mode with cylinder numbers one and four on intake stroke and cylinder numbers two and three on exhaust strokes. The exhaust strokes of each cylinder repeat every two strokes. Likewise, the intake strokes of each cylinder repeat every two strokes. Thus, one engine cycle occurs for every two strokes, or every crankshaft revolution.

Between time t0 and time t1, the engine operates with all of its cylinders in a two stroke mode where the engine does not generate torque to keep the engine rotating. Instead of generating torque by combusting air-fuel mixtures, heat is generated by the engine combusting air-fuel mixtures. Combustion byproducts (e.g., exhaust gases) and heated air-fuel mixtures are delivered to a catalyst in the exhaust system for combustion in the catalyst. The heating of air-fuel mixtures may be achieved via combusting air and fuel in a first group of cylinders and delivering exhaust gases to the exhaust system without generating net positive torque to rotate the crankshaft. During the intake strokes of the respective cylinders, the intake valves open near top dead center and they close before bottom dead center. However, the described intake valve timing and the intake valve timing shown in FIG. 3 may be adjusted to optimize heat release and to improve combustion. Fuel is injected twice for cylinders that are on their intake strokes. The first injection (e.g., pilot injection) is early in the intake stroke and the second injection (e.g., main injection) is near the center of the intake stroke to reduce cylinder wall wetting and improve air-fuel mixing. Spark is delivered late in the intake stroke when the intake valves of the cylinder receiving the spark is closed. The exhaust valves open near top dead center so that the heat of combustion may be released into the exhaust system to heat the catalyst without generating a net positive engine torque. However, the described exhaust valve timing and the intake valve timing shown in FIG. 3 may be adjusted to optimize heat release and to improve combustion for a particular engine.

In this example, combustion in the engine begins with combustion in all of the engine's cylinders for the first intake strokes of the cylinders since time t0. Spark events 350 and 352 are shown as circled asterisks to indicate that these spark events are optional. However, in other examples, spark events 350 and 352 may be omitted where it may be desirable to generate less heat in the engine. Spark events 350 and 352 may be desired during some example engine starts to provide a larger heat plume to the catalyst at the onset of engine combustion in an effort to reduce hydrocarbon slip past the electrically heated catalyst. Thus, a predetermined number of spark events may be delivered via a second group of cylinders (e.g., cylinder numbers three and four) before spark delivery to the second group of cylinders ceases while spark may be delivered to a first group of cylinders (e.g., cylinder numbers one and two) until and after a catalyst reaches a threshold temperature (e.g., a catalyst light off temperature). Once spark delivery is ceased to the second group of cylinders, fuel and air may be delivered to the catalyst by the second group of cylinders.

At time t1, the engine begins to transition from operating all cylinders in two stroke mode to operating all cylinders in four stroke mode. The transition may begin in response to a temperature of a catalyst reaching a light off temperature. The transition to four stroke mode begins with cylinder number one. In particular, compression and expansion strokes are added to the cycle of the engine beginning with cylinder number one. The intake valves of cylinder number one begin to open every four strokes and the exhaust valves begin to open every four strokes. In addition, the opening timing duration of the intake valves and opening timing duration of the exhaust valves for cylinder number one are adjusted. Fuel injection into cylinder number is adjusted such that a first injection occurs in the intake stroke of cylinder number one and a second injection occurs during a compression stroke of cylinder number one, the intake and compression strokes occurring in the same engine cycle. Spark timing is adjusted in cylinder number one from the intake stroke of cylinder number one to the compression stroke of cylinder number one. Cylinder numbers 2-4 transition into four stroke mode according to the order of combustion in the cylinders.

In this way, an engine may be operated in a two stroke mode to increase the delivery of thermal energy to a catalyst so that the catalyst may light off faster, thereby reducing tailpipe emissions. While operating in two stroke mode, the engine may generate zero or less than zero net torque. Consequently, a greater quantity of heat may be delivered to a catalyst from a given amount of fuel that is injected to an engine.

Referring now to FIG. 4, a flow chart of a method for operating an engine is shown. The method of FIG. 4 may be incorporated into and may cooperate with the system of FIGS. 1 and 2. Further, at least portions of the method of FIG. 4 may be incorporated as executable instructions stored in non-transitory memory while other portions of the method may be performed via a controller transforming operating states of devices and actuators in the physical world.

At 402, method 400 determines vehicle operating conditions. Vehicle operating conditions may include but are not limited to vehicle status (e.g., activated/deactivated), engine speed, vehicle speed, engine operating state (e.g., activated/deactivated), engine operating mode (e.g., two stroke/four stroke), driver demand torque or power, and ambient environmental conditions. Method 400 may determine the vehicle operating conditions via the sensors described herein. Method 400 proceeds to 404.

At 404, method 400 judges whether or not an engine cold start is requested. An engine cold start may be requested via input to a human/machine interface or via a signal from a remote device while engine temperature is less than a threshold temperature (e.g., less than 29° C.). If method 400 judges that an engine cold start is requested, the answer is yes and method 400 proceeds to 406. Otherwise, the answer is no and method 400 proceeds to 450.

At 450, method 400 continues to operate the engine in its present mode. For example, if the engine is activated and combusting fuel and air, the engine continues to combust fuel and air. If the engine is not activated, the engine remains deactivated. Method 400 proceeds to exit.

At 406, method 400 activates an electrically heated catalyst in the engine's exhaust system. The electrically heated catalyst may be activated via supplying electric power to the electrically heated catalyst. Method 400 proceeds to 408.

At 408, method 400 may delay rotating the engine for a predetermined amount of time to give the electrically heated catalyst time to reach a desired temperature. Method 400 proceeds to 410.

At 410, method 400 increases rotational speed of the engine to an engine at an idle speed (e.g., 1200 RPM) via an electric machine. Method 400 may also switch cam profiles or valve timing in other ways so that the engine assumes a two stroke mode as shown in FIG. 3. In particular, each engine cylinder has only intake and exhaust strokes during a cycle of the engine (e.g., one revolution). Method 400 proceeds to 412.

At 412, method 400 begins delivering fuel to each engine cylinder. In particular, fuel is delivered to each engine cylinder via two separate injections, and the overall engine air-fuel ratio may be lean of stoichiometry. The first injection (e.g., pilot injection) may be timed to occur during an early portion of an intake stroke of the cylinder that is receiving the fuel (e.g., between TDC intake stroke of the cylinder receiving the fuel and 90 crankshaft degrees after TDC intake stroke of the cylinder receiving the fuel). The second injection (e.g., main injection) may be timed to occur during a later portion of the intake stroke of the cylinder that is receiving the fuel (e.g., between 90 after TDC intake stroke of the cylinder receiving the fuel and BDC intake stroke of the cylinder that is receiving the fuel). FIG. 3 shows an example of how fuel may be injected while the engine is operating in two stroke mode. Method 400 proceeds to 414.

At 414, method 400 operates the engine in two stroke mode where intake valves and exhaust valves are opened for each cylinder every engine cycle (e.g. one crankshaft revolution). In one example, the intake valves are opened near TDC intake stroke (e.g., within +20 crankshaft degrees of TDC intake stroke) and the intake valves are closed before BDC intake stroke (e.g., in a range of zero to 70 crankshaft degrees before BDC intake stroke). The exhaust valves are opened near BDC exhaust stroke (e.g., within ±20 crankshaft degrees of BDC exhaust stroke) and closed near TDC exhaust stroke (e.g., within ±20 crankshaft degrees of TDC exhaust stroke).

In a first example as shown in FIG. 3, spark may be initially delivered to all engine cylinders during the cold engine start to provide an initial heat plume to the catalyst and exhaust system. The initial heat plume may ready the catalyst for receiving larger air fuel mixture amounts. Shortly thereafter, spark may be provided to half of the engine cylinders and spark may not be provided to half of the engine's cylinders so that greater amounts of chemical energy may be delivered to the catalyst in an effort to reduce an amount of time it takes for a catalyst to reach light off temperature. For example, after delivering spark for a predetermined actual total number of combustion events in a cylinder, spark delivery to the cylinder may cease, and spark delivery to up to one half of engine cylinders may be provided and then ceased in this way during an engine cold start. Spark may be provided to an engine cylinder when the engine cylinder's intake valves are closed so as to reduce a possibility of exhaust gases entering the intake manifold, which may be undesirable. Spark may be provided to all engine cylinders this way while the engine operates in two stroke mode.

In a second example, method 400 may deliver spark to half engine cylinders and may not provide spark to the other half of the engine's cylinders the entire time that the engine is operated in a two stroke mode. For example, the two spark events in FIG. 3 that are denoted with circled asterisks may be removed to make the sequence in FIG. 3 equivalent to the second example that is described here. This second example may increase the flow rate of air and fuel to the catalyst to provide a desired rate of heating within the catalyst. Method 400 proceeds to 416.

At 416, method 400 judges whether or not the catalyst temperature has reached or exceeds a threshold temperature (e.g., a catalyst light off temperature). If so, the answer is yes and method 400 proceeds to 418. Otherwise, the answer is no and method 400 returns to 410.

At 418, method 400 transitions the engine from operating in two stroke mode to operating the engine in four stroke mode. In particular, intake and exhaust valve timings are adjusted to add a compression stroke and an expansion stroke in between intake and exhaust strokes for each cylinder as shown in FIG. 3. In addition, spark timing may be adjusted to occur within compression strokes of the respective engine cylinders. Method 400 proceeds to 420

At 420, method 400 adjusts fuel injection timing for four stroke mode. In one example, method 400 supplies a first injection to each cylinder receiving fuel during an intake stroke of the cylinder that is receiving the fuel. Method 400 also supplies a second injection to each cylinder receiving fuel during a compression stroke of the cylinder that is receiving the fuel. Method 400 proceeds to exit.

In this way, method 400 may heat an engine and catalyst without losing energy from air-fuel mixtures that are supplied to the engine to rotate the engine. Thus, energy from an air-fuel mixture that may conventionally be used to rotate an engine may be supplied to heat a catalyst during an engine cold start. In addition, a mass flow rate of air and fuel that is supplied to the catalyst may be increased by operating the engine in a two stroke mode.

Thus, the method of FIG. 4 provides for a method for operating an engine via a controller, comprising: prior to a catalyst temperature reaching a light off temperature after an engine cold start, operating all cylinders of the engine in a two stroke mode, combusting fuel in a first group of cylinders of the engine, and not combusting fuel in a second group of cylinders of the engine. In a first example, the method further comprises rotating the engine at an engine idle speed via an electric machine in response to a request to cold start the engine. In a second example that may include the first example, the method includes where the first group of cylinders includes a same actual total number of cylinders as the second group of cylinders. In a third method that may include one or more of the first and second method, the method further comprises activating an electrically heated catalyst prior to combusting fuel in the first group of cylinders in response to a request to cold start the engine. In a fourth method that may include one or more of the first through third methods, the method includes where combusting fuel in the first group of cylinders includes delivering spark to the first group of cylinders while intake valves in the first group of cylinders are closed and during intake strokes of cylinders included in the first group of cylinders. In a fifth method that may include one or more of the first through fourth methods, the method further comprises operating all cylinders of the engine in a four stroke mode in response to the catalyst temperature exceeding the light off temperature. In a fifth method that may include one or more of the first through fourth methods, the method further comprises injecting fuel twice to a cylinder of the engine during an intake stroke of the cylinder. In a sixth method that may include one or more of the first through fifth methods, the includes where the cylinder is in the first group of cylinders. In a seventh method that may include one or more of the first through sixth methods, the method includes where the cylinder is in the second group of cylinders.

The method of FIG. 4 also provides for a method for operating an engine via a controller, comprising: cold starting the engine via operating all cylinders of the engine in a two stroke mode and combusting fuel in all cylinders of the engine in response to an engine cold start request; and prior to a catalyst temperature reaching a light off temperature after cold starting the engine, operating all cylinders of the engine in the two stroke mode, combusting fuel in a first group of cylinders of the engine, and not combusting fuel in a second group of cylinders of the engine. In a first example, the method includes where all cylinders of the engine are operated in the two stroke mode and combusting fuel for a predetermined number of engine cycles. In a second method that may include the first method, the method further comprises activating an electrically heated catalyst in response to the engine cold start request. In a third method that may include one or more of the first and second methods, the further comprises rotating the engine at idle speed via an electric machine in response to the cold start request. In a fourth method that may include one or more of the first through third methods, the method further comprises supplying spark to a cylinder in the first group of cylinders while an intake valve of the cylinder is closed.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, at least a portion of the described actions, operations and/or functions may graphically represent code to be programmed into non-transitory memory of the computer readable storage medium in the control system. The control actions may also transform the operating state of one or more sensors or actuators in the physical world when the described actions are carried out by executing the instructions in a system including the various engine hardware components in combination with one or more controllers.

This concludes the description. The reading of it by those skilled in the art would bring to mind many alterations and modifications without departing from the spirit and the scope of the description. For example, single cylinder, I3, I4, I5, V6, V8, V10, and V12 engines operating in natural gas, gasoline, diesel, or alternative fuel configurations could use the present description to advantage.

The invention claimed is:

1. A method for operating an engine via a controller, comprising:

prior to a catalyst temperature reaching a light off temperature after an engine cold start, operating all cylinders of the engine in a two stroke mode, combusting fuel in a first group of cylinders of the engine, and not combusting fuel in a second group of cylinders of the engine.

2. The method of claim 1, further comprising rotating the engine at an engine idle speed via an electric machine in response to a request to cold start the engine.

3. The method of claim 1, where the first group of cylinders includes a same actual total number of cylinders as the second group of cylinders.

4. The method of claim 1, further comprising activating an electrically heated catalyst prior to combusting fuel in the first group of cylinders in response to a request to cold start the engine.

5. The method of claim 1, where combusting fuel in the first group of cylinders includes delivering spark to the first group of cylinders while intake valves in the first group of cylinders are closed and during intake strokes of cylinders included in the first group of cylinders.

6. The method of claim 1, further comprising operating all cylinders of the engine in a four stroke mode in response to the catalyst temperature exceeding the light off temperature.

7. The method of claim 1, further comprising injecting fuel twice to a cylinder of the engine during an intake stroke of the cylinder.

8. The method of claim 7, where the cylinder is in the first group of cylinders.

9. The method of claim 7, where the cylinder is in the second group of cylinders.

10. A system, comprising:

an internal combustion engine;

an electric machine coupled to the internal combustion engine; and a controller including executable instructions stored in non-transitory memory that cause the controller to operate a first group of cylinders in a two stroke mode while combusting fuel in the first group of cylinders, operate a second group of cylinders in the two stroke mode while not combusting fuel in the second group of cylinders, and inject fuel to the second group of cylinders while not combusting fuel in the second group of cylinders.

11. The system of claim 10, further comprising additional instructions that cause the controller to inject fuel twice during an intake stroke of a cylinder included in the second group of cylinders while operating the second group of cylinders in the two stroke mode.

12. The system of claim 10, further comprising additional instructions that cause the controller to supply spark to a cylinder during an intake stroke of the cylinder, the cylinder included in the first group of cylinders.

13. The system of claim 12, where the spark is supplied while an intake valve of the cylinder is closed.

14. The system of claim 10, further comprising an electric machine and additional instructions that cause the controller to rotate the internal combustion engine at an idle speed via the electric machine.

15. The system of claim 10, where the first group of cylinders and the second group of cylinders are operated in the two stroke mode prior to a catalyst temperature reaching a light off temperature after an engine cold start.

16. A method for operating an engine via a controller, comprising:

cold starting the engine via operating all cylinders of the engine in a two stroke mode and combusting fuel in all cylinders of the engine in response to an engine cold start request; and prior to a catalyst temperature reaching a light off temperature after cold starting the engine, operating all cylinders of the engine in the two stroke mode, combusting fuel in a first group of cylinders of the engine, and not combusting fuel in a second group of cylinders of the engine.

17. The method of claim 16, where all cylinders of the engine are operated in the two stroke mode and combusting fuel for a predetermined number of engine cycles.

18. The method of claim 17, further comprising activating an electrically heated catalyst in response to the engine cold start request.

19. The method of claim 18, further comprising rotating the engine at idle speed via an electric machine in response to the engine cold start request.

20. The method of claim 19, further comprising supplying spark to a cylinder in the first group of cylinders while an intake valve of the cylinder is closed.

* * * * *